US005455150A

United States Patent [19]

Mooberry et al.

[11] Patent Number: 5,455,150

[45] Date of Patent: Oct. 3, 1995

[54] COLOR PHOTOGRAPHIC NEGATIVE ELEMENTS WITH ENHANCED PRINTER COMPATIBILITY

[75] Inventors: Jared B. Mooberry; Paul B. Merkel, both of Rochester; Stephen P. Singer, Spencerport, all of N.Y.

[73] Assignee: Eastman Kodak Company, Rochester, N.Y.

[21] Appl. No.: 75,068

[22] Filed: Jun. 10, 1993

[51] Int. Cl.[6] ..... G03C 1/46

[52] U.S. Cl. ..... 430/504; 430/357; 430/359; 430/507; 430/577; 430/519; 430/522

[58] Field of Search ..... 430/357, 359, 430/504, 507, 517, 519, 522

[56] References Cited

U.S. PATENT DOCUMENTS

| | | | |
|---|---|---|---|
| 2,265,547 | 4/1938 | Schneider | 430/357 |
| 2,632,004 | 9/1949 | Minsk | 430/519 |
| 2,860,979 | 11/1958 | Straley | 430/519 |
| 4,040,840 | 8/1977 | Sugiyama et al. | 430/522 |
| 4,110,115 | 8/1978 | Sugiyama et al. | 530/507 |
| 4,336,323 | 6/1982 | Winslow | 430/519 |
| 4,952,487 | 8/1990 | Renner et al. | 430/555 |
| 5,037,728 | 8/1991 | Shiba et al. | 430/504 |
| 5,238,797 | 8/1993 | Hirabayashi et al. | 430/508 |

FOREIGN PATENT DOCUMENTS

| | | |
|---|---|---|
| 0319999 | 9/1988 | European Pat. Off. . |
| 0529737 | 3/1993 | European Pat. Off. . |
| 58-014832 | 1/1983 | Japan . |
| 63040143 | 5/1986 | Japan . |
| 62-156372 | 7/1987 | Japan . |
| 1-048862 | 2/1989 | Japan . |
| 2165133 | 6/1990 | Japan . |
| 05150430 | 11/1991 | Japan . |
| 05150429 | 11/1991 | Japan . |

OTHER PUBLICATIONS

Research Disclosure, Mar. 1974, No. 11909, "Stabilized dyes".

*Primary Examiner*—Charles L. Bowers, Jr.
*Assistant Examiner*—Geraldine Letscher
*Attorney, Agent, or Firm*—Gordon M. Stewart

[57] ABSTRACT

A silver halide photographic negative has a red sensitive layer containing a coupler which reacts with oxidized color developer to form a cyan dye, a blue sensitive layer containing a coupler which reacts with oxidized color developer to form a yellow dye, and a green sensitive layer containing a coupler which reacts with oxidized color developer to form a magenta dye. The coupler in the green sensitive layer produces a magenta dye which has relatively low density in the 560–590 nm range as compared with magenta dyes produced by pyrazolotriazole type couplers or 1-phenyl-3-acylamino-5-pyrazolone couplers. The element additionally has an inert dye present, preferably positioned below the green sensitive layer containing the foregoing coupler. The inert dye has a peak absorption between 560–590 nm so that the negative has a ratio of density at 580 nm to density at 550 nm, both as measured at neutral midscale exposure, which is greater than exhibited by the element absent the inert dye.

25 Claims, No Drawings

COLOR PHOTOGRAPHIC NEGATIVE ELEMENTS WITH ENHANCED PRINTER COMPATIBILITY

FIELD OF THE INVENTION

This invention relates to color photographic negative elements containing particular types of image-dye forming couplers and an inert dye to enhance printer compatibility of the negative.

BACKGROUND OF THE INVENTION

The color negative-positive photographic system relies on the exposure of a scene onto a color negative film. The exposed negative is then projected onto a negative-working color photographic paper to form, after development, the desired positive image. In order to correctly expose the photographic paper, the average density of the negative in all three color records (red, green and blue) must be measured so that the exposure time and balance between the relative amounts of the different colored light used to expose the paper can be adjusted.

The general practice in the photofinishing industry is to read the average color density of the negative using red, green and blue filters. There is no uniform standard for these filters. Different sets of filters may read the same negative differently because of variations in the amount of light they pass. In most cases, this is not a problem since the response of a printer filter set is accounted for in the calculation for the subsequent exposure of the paper. However, this method assumes that the measured red, green and blue densities of any and all negatives to be printed by a particular printer system reflects the color balance of the original scene.

Pyrazolotriazoles have been used as magenta couplers in commercially available color negative films and can offer useful photographic advantages depending on format. The hues of the magenta dyes formed from pyrazolotriazoles are broad in terms of bandwidth, with substantial density at wavelengths from 560 to 590 nm. 1-Phenyl-3-acylamino-5-pyrazolones are also used as magenta couplers in commercially available color negative films and can offer useful photographic advantages depending on format. The hues of the magenta dyes formed from 1-phenyl-3-acylamino-5-pyrazolones are broad in terms of bandwidth, with substantial density at wavelengths from 560 to 590 nm, similar to pyrazolotriazole based dyes.

1-Phenyl-3-anilino-5-pyrazolones are also used as magenta couplers in commercially available color negative films and can offer useful photographic advantages depending on format. However, the hues of the magenta dyes formed from 1-phenyl-3-anilino-5-pyrazolones are narrower in bandwidth than those formed from pyrazolotriazoles or 1-phenyl-3-acylamino-5-pyrazolones, with much less density at wavelengths from 560 to 590 nm. Although the foregoing numbers may vary depending on the particular color developer used, for most color developers they will be within a few nanometers. In the present application, all of the wavelength measurements given are with reference to development of the element with 2-[(4-amino-3-methyl phenyl)ethylamino]ethanol, as typically used in the industry for development of negative films as in KODAK FLEXICOLOR II Process (*British Journal of Photography Annual*, 1988, pp 196–198).

Thus, negative films using each of the above types of magenta couplers can be prepared so that the red, green (measured at one wavelength, i.e. 550 nm) and blue densities are matched. However, the film with the 1-phenyl-3-anilino-5-pyrazolone magenta coupler would have less density in the region of 560 to 590 nm than the others. Printers whose green filters do not significantly read densities at wavelengths greater than 560 nm would record all three films as having the same green density. Printers with green filters that read density at wavelengths longer than 560 nm, though, would measure the film containing a 1-phenyl-3-anilino-5-pyrazolone as having less green density than the others. Since the red and blue density readings are relatively independent of the magenta coupler, such a printer would not give the film containing the 1-phenyl- 3-anilino-5-pyrazolone the same exposure as the films with the other magenta couplers. With this type of printer, paper images printed from a film containing 1-phenyl-3-anilino-5-pyrazolone magenta coupler would not have the same color balance as films containing either of the other two magenta couplers. For example, commercially used printers such as KODAK Printer Models 2610 or 3510 have green filters that do not read significant amounts of density at greater than 560 nm and so read films with these different classes of magenta couplers as roughly equivalent. However, other commercially available printers such as the KODAK Class 35 Printer or the NORITSU 1001 Minilab have green filters that will read films with these different classes of couplers as different in overall green density.

In order to get color prints with matched color balance from films containing any of these three magenta couplers when printed in printers that read significant amounts of density from 560 to 590 nm, photofinishers must either segregate the films so that the correct calculation of the exposure for that particular film can be made, or photofinishers can manually adjust the color balance during the printing operation. These operations are undesirable, leading to higher operating costs, decreased printer output and increased chance of operator error. It would be desirable to have color negative films containing 1-phenyl- 3-anilino-5-pyrazolone magenta couplers or other couplers which produce a magenta image dye with low density in the 560 to 590 nm range, which can be printed in different printers without segregating them from other films or manually adjusting color balance, and still obtain paper prints with good color balance.

SUMMARY OF THE INVENTION

The foregoing objective can be obtained in films having a color coupler which produces a magenta image dye with low density in the 560 to 590 nm range, by additionally providing in the film an inert dye with a peak absorption between 560–590. As a result, the green density of such films appears to printers with green filters that read density at wavelengths longer than 560 nm, to be more like films containing pyrazolotriazole or 1-phenyl-3-acylamino-5-pyrazolone couplers. Thus, such films of the present invention are more compatible during printing operations on any printer, with films containing other classes of magenta couplers. "More compatible" means that films of the invention will give closer responses to films using other magenta couplers as described above (such as 1-phenyl- 3-acylamino-5-pyrazolone magenta couplers) in terms of green density, regardless of the type of printer or green filter set used. This in turn implies that the final paper image formed from the different film negatives will be more alike in overall color balance.

In particular, the present invention provides a silver halide color photographic negative comprising a red sensitive layer containing a coupler which reacts with oxidized color color developer to form a cyan dye, a blue sensitive layer containing a coupler which reacts with oxidized color developer to form a yellow dye, and a green sensitive layer containing a color coupler which upon reaction with oxidized color developer forms a magenta image dye. The element additionally comprises an inert dye having a peak absorption between 560–590 nm so that the negative has a $D_{580}/D_{550}$ which is greater than exhibited by the element absent the inert dye. By $D_{580}$, $D_{550}$, $D_{640}$ and the like, is meant the density at 580 nm, 550 nm, 640 nm and the like, of the film. Unless otherwise indicated, it will be understood that the foregoing and other density values are measured at a "neutral midscale exposure" of the film. For the purposes of this application, neutral midscale exposure refers to a neutral (that is, all three color records) exposure at +0.82 logE exposure units over the ISO speed of the element. This approximates the average density region (often referred to as a midscale exposure) of a correctly exposed negative.

EMBODIMENTS OF THE INVENTION

The present invention has particular application in color photographic negatives of the foregoing type wherein $D_{580}/D_{550}$ of the element at neutral midscale exposure, absent the inert dye, is 0.75 or less (particularly where $D_{580}/D_{550}$ is 0.60 or less or is even 0.50 or less). The inert dye should provide an increase of $D_{580}/D_{550}$ of at least 0.01, and preferably at least 0.04 (and more preferably at least 0.10). By the dye being "inert" as used in this application, is meant that the dye is not decolorized or removed during photographic processing of the negative. The half bandwidth ("HBW") of the inert dye can be 20–200 nm, preferably between 50–150 nm. "HBW" is the width of the absorption peak at ½ maximum height. It is also preferred to keep an increase in red density which may be provided by the inert dye to a minimum. In this regard, it is preferred that any increase of $D_{640}/D_{550}$ of the element at neutral midscale exposure, which is caused by the inert dye, is less than the amount the inert dye increases $D_{580}/D_{550}$ at neutral midscale exposure.

It is preferred that the inert dye is non-diffusible, that is during long term storage it preferably remains in the layer in which it is coated. This can be accomplished, for example, by ballasting the dye or attaching it to a polymeric backbone. Also, in the case of insoluble pigments or dye particles, movement can be prevented by physical state. The range of density at 580 nm provided by the dye or colorant should be between 0.001 and 2.0, preferably between 0.005 and 1.0. Typically, the levels for inert dyes, particularly dye I, II or III below, would be between about 0.0002 g/m$^2$ to 5 g/m$^2$, or 0.001 g/m$^2$ to 2 g/m$^2$, or more preferably 0.01 to 1 g/m$^2$. The inert dye can be located anywhere in the film element, but is preferably located below all of the green sensitive layers (that is, in a direction further away from the light source when the element is exposed in normal use with the light sensitive layers closer to the light source than the support). For example, the inert dye can be located between the green sensitive layer and the support. However, the inert dye can also be in the support or on the opposite side of the support from the emulsion layers. The most preferred location is in an anti-halation layer.

It will be appreciated that many different types of inert dyes could be used in the present invention provided they meet the above requirements in any particular negative element. Classes of dyes which can be useful are described, for example, in *The Chemistry of Synthetic Dyes and Pigments*, H. A. Lubs (Editor), Reinhold Publishing Co, New York, 1955; K. Venkataraman, *The Chemistry of Synthetic Dyes*, Volumes 1–8, Academic Press, New York, 1952; *Light Absorption of Organic Colorants*, J. Fabian and H. Hartman, Springer Verlag, New York, 1980; *Color and Constitution of Organic Molecules*, J. Griffiths, Academic Press, New York, 1976. As to particular types of inert dyes which may be used in the present invention, while many inert dyes, both organic and inorganic, could be used which satisfy the criteria specified above, it is preferred that organic dyes be azo dyes, methine dyes, or azamethine dyes. Azo dyes have the structure $R_a$—N=N—$R_b$. Methine dyes have the structure $R_aR_bC{=}CR_cR_d$. Azamethine dyes have the structure $R_a$—N=$CR_aR_b$. In the foregoing $R_a$, $R_b$, $R_c$ and $R_d$ are substituents chosen to give the desired hue. Particularly preferred members of the foregoing type of dyes are selected from dyes having the structure I, II or III below:

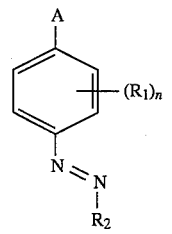

I

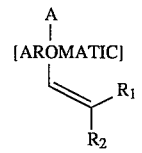

II

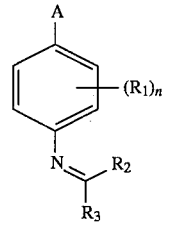

III where A is a substituted or unsubstituted auxochrome, (that is a polar substituent such as oxygen or nitrogen, which intensifies the color of the dye) which can optionally be part of a heterocyclic ring system; $R_1$, $R_2$, and $R_3$ are independently H or substituents provided that $R_1$ can represent an annelated aromatic ring system or that $R_1$ and $R_2$ or $R_2$ and $R_3$ can form a ring. AROMATIC represents any aromatic carbocyclic or aromatic heterocyclic ring system. In addition, the organic dye can be a metallized dye that contains metal ions such as Ni, Zn or Fe which form an integral part of the chromophore.

Inert dyes can be incorporated into photographic films of the present invention by any method known in the art, such as oil in water dispersions, polymers, solid particles, or latexes. Such are known in Research Disclosure I identified later in this application.

Examples of inert dyes which can be used in the present invention include the following dyes:

Cmpd #1
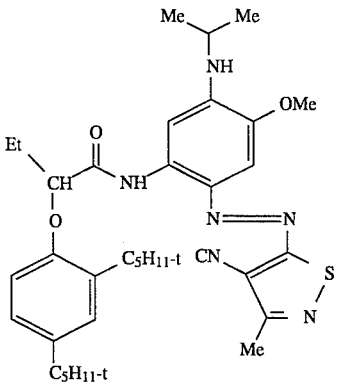
Cmpd #2
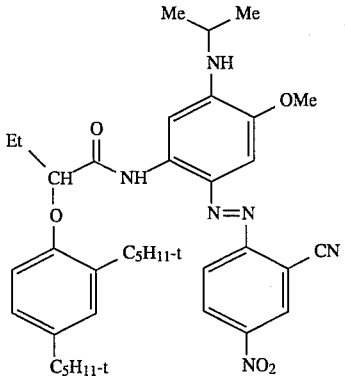
Cmpd #3
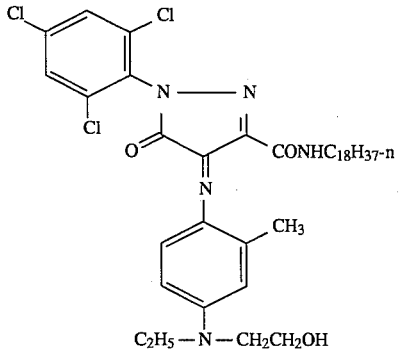
Cmpd #4
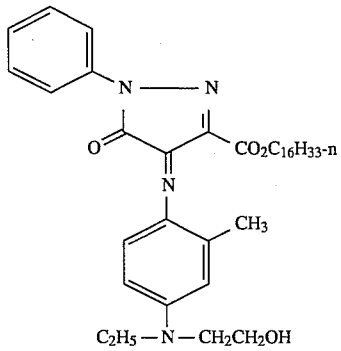

-continued
Cmpd #5
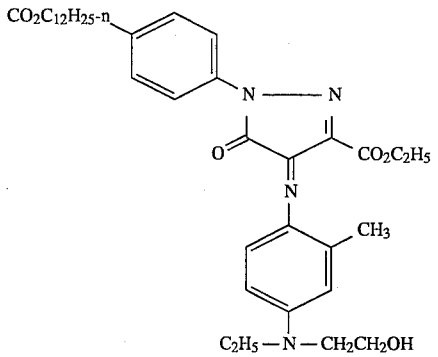
Cmpd #6
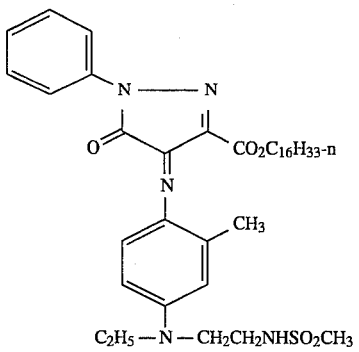
Cmpd #7
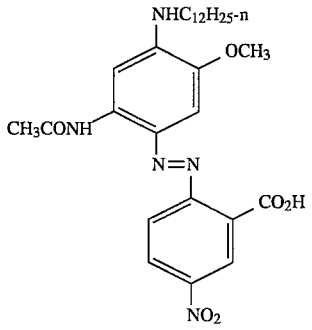
Cmpd #8
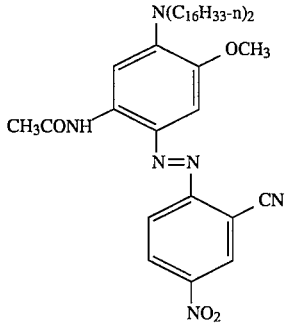
Cmpd #9
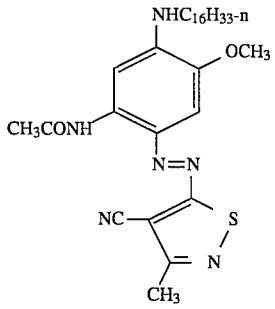

-continued
Cmpd #10
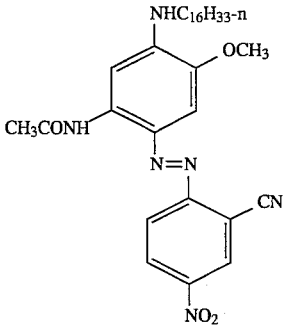
Cmpd #11
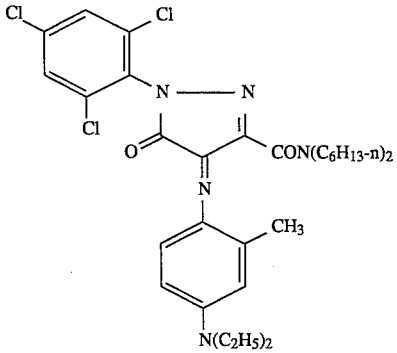
Cmpd #12
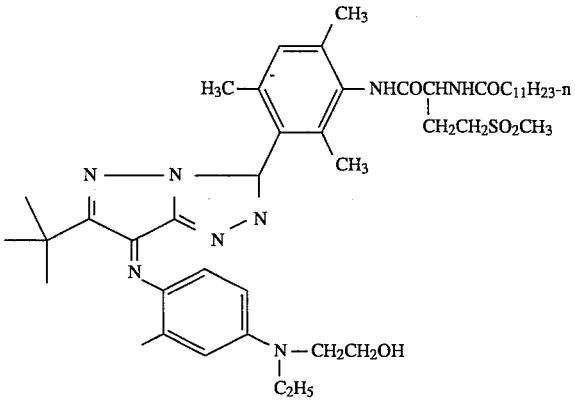
Cmpd #13
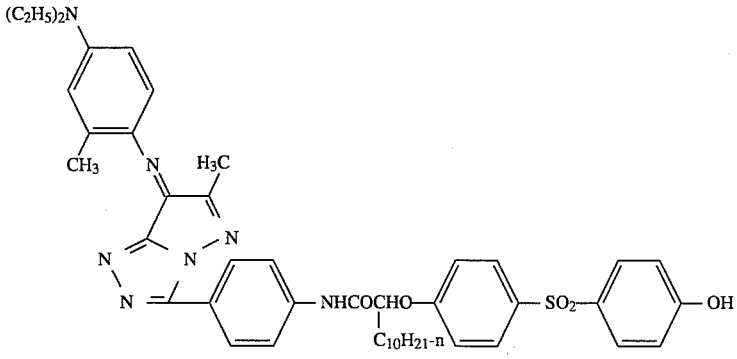

-continued
Cmpd #14
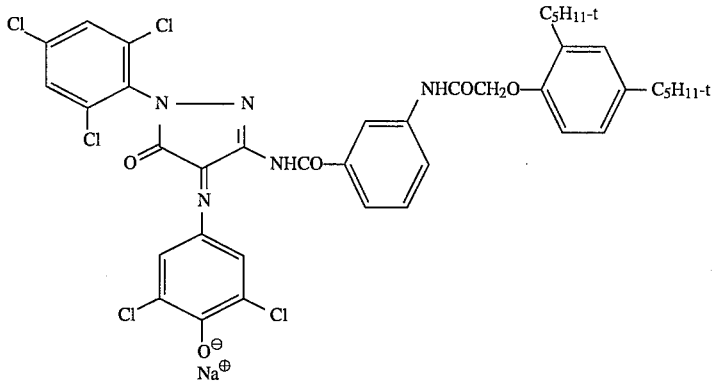
Cmpd #15
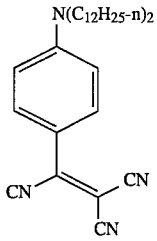
Cmpd #16
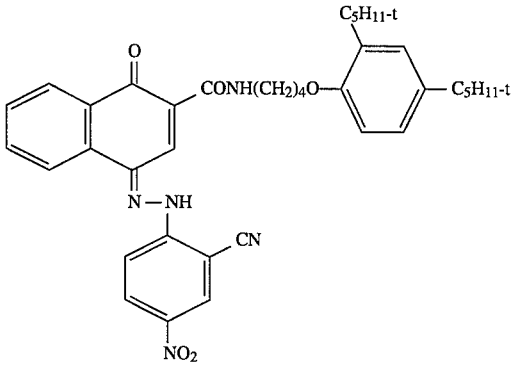
Cmpd #17
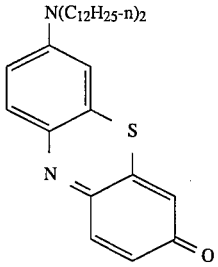
Cmpd #18
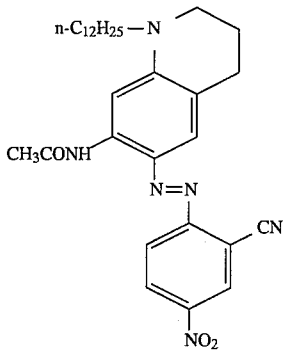

-continued
Cmpd #19
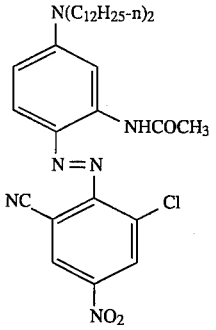
Cmpd #20
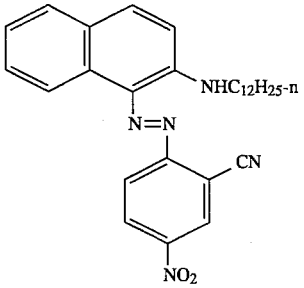
Cmpd #21
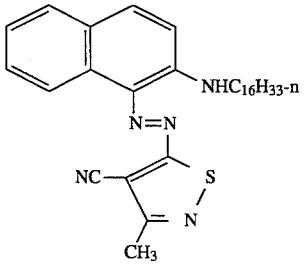
Cmpd #22
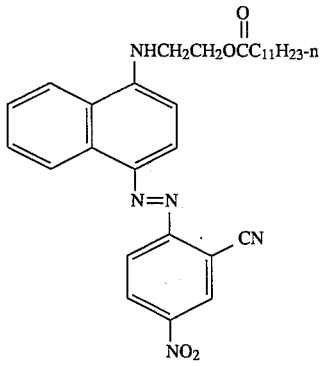
Cmpd #23
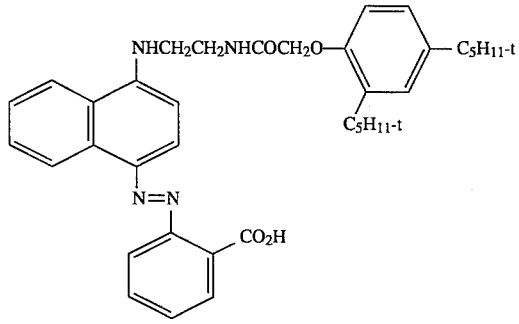

-continued
Cmpd #24
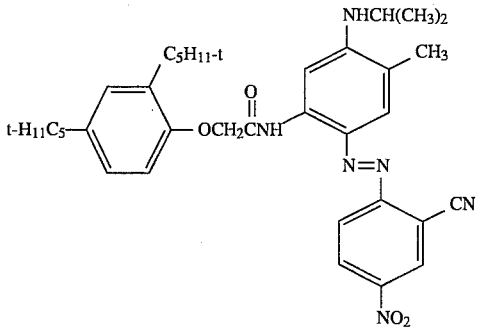
Cmpd #25
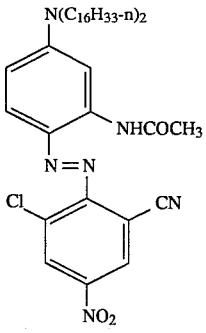
Cmpd #26
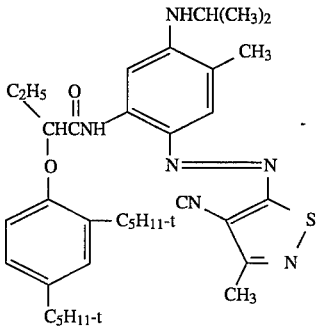
Cmpd #27
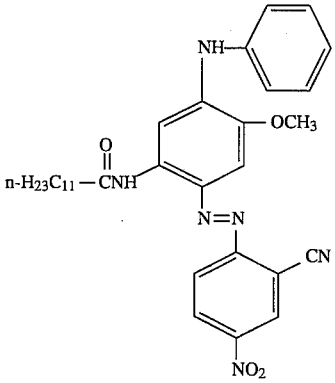

-continued
Cmpd #28
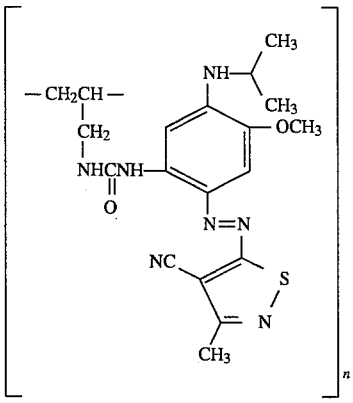
Cmpd #29
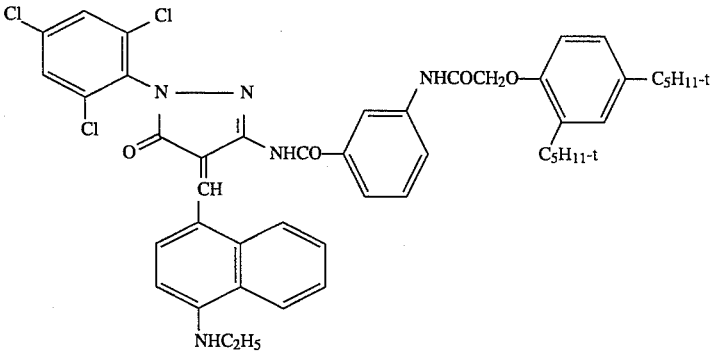
Cmpd #30
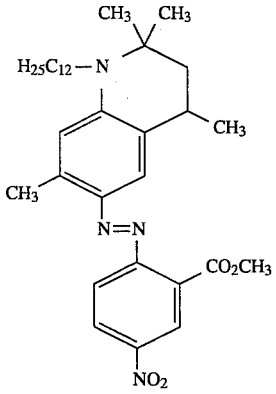
Cmpd #31
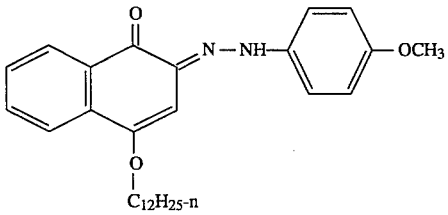
Cmpd #32
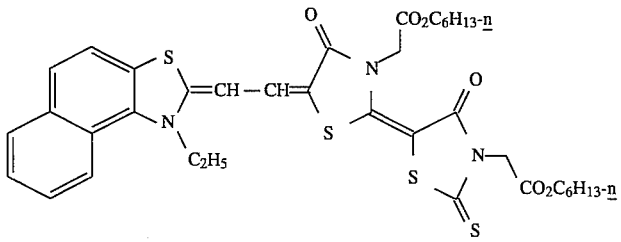

-continued
Cmpd #33
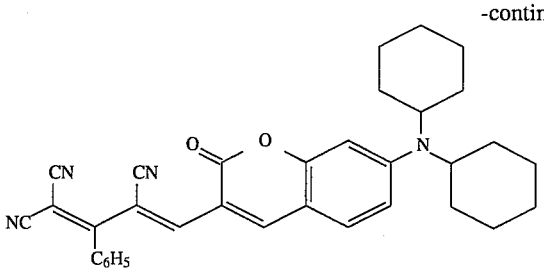
Cmpd #34
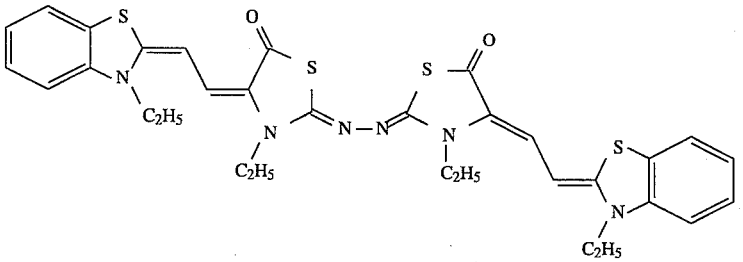
Cmpd #35
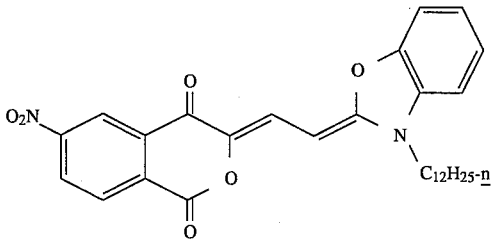
Cmpd #36
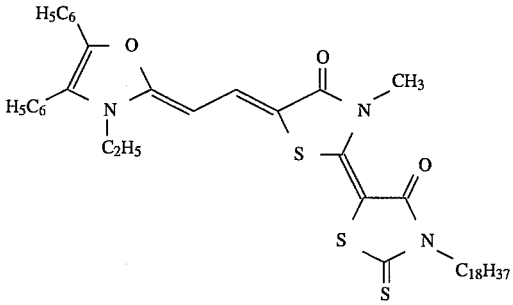
Cmpd #37
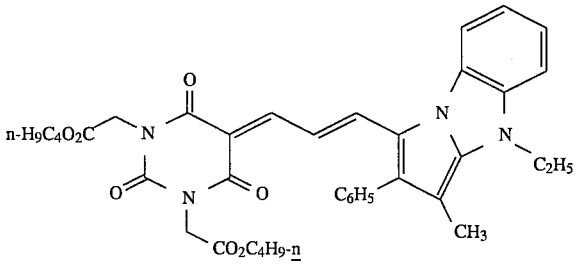
Cmpd #38
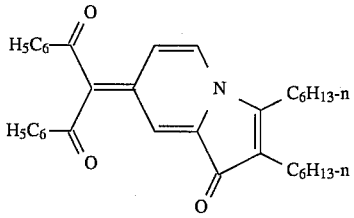

-continued
Cmpd #39
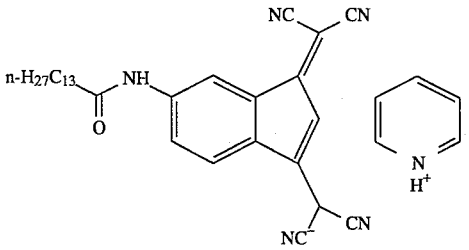
Cmpd #40
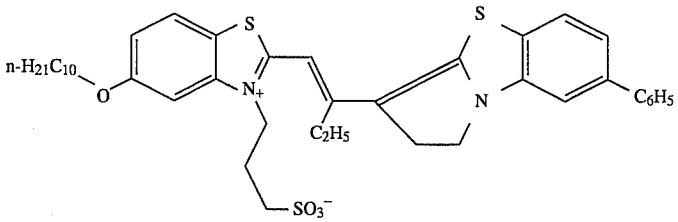
Cmpd #41
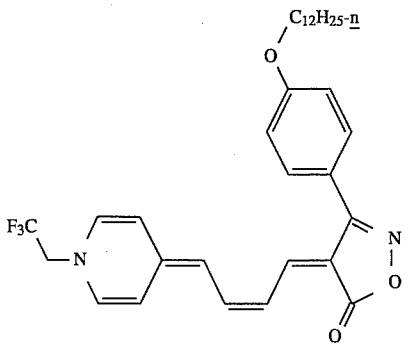
Cmpd #42
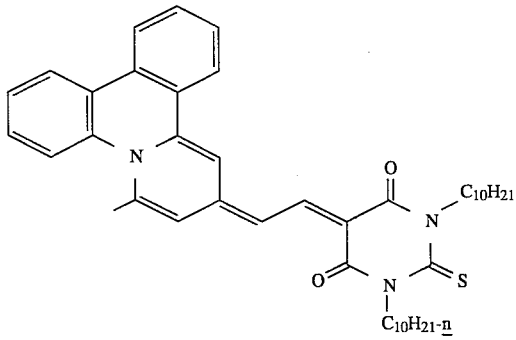
Cmpd #43
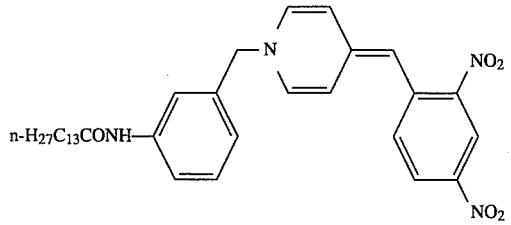
Cmpd #44
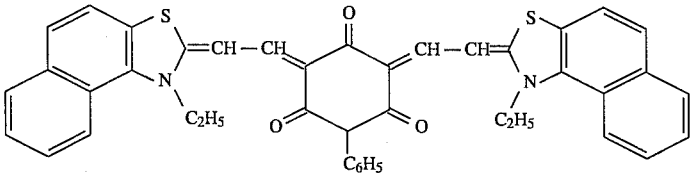

-continued
Cmpd #45
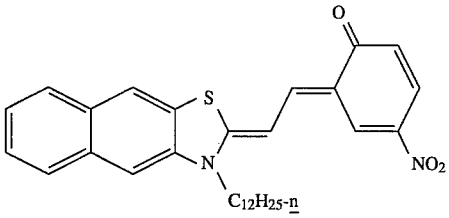
Cmpd #46
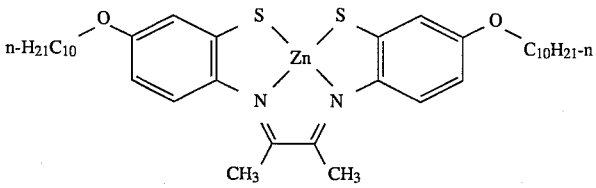
Cmpd #47
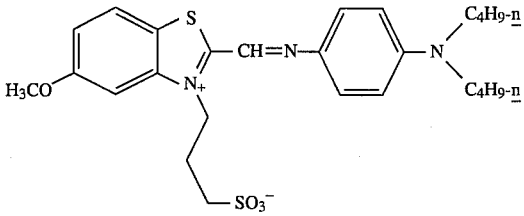
Cmpd #48
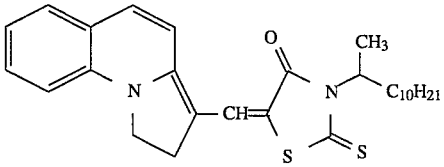
Cmpd #49
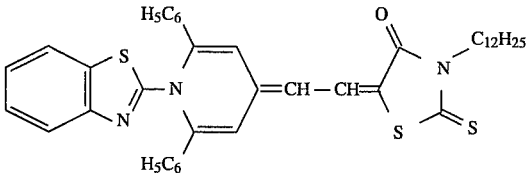
Cmpd #50
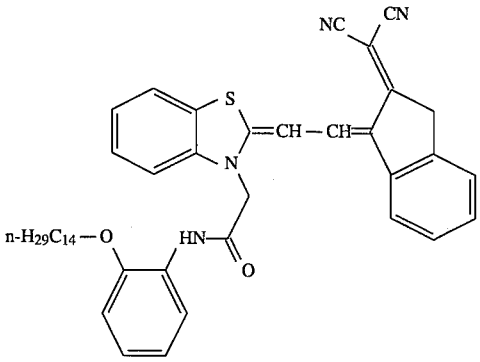
Cmpd #51
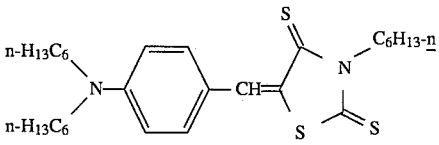

-continued

Cmpd #52

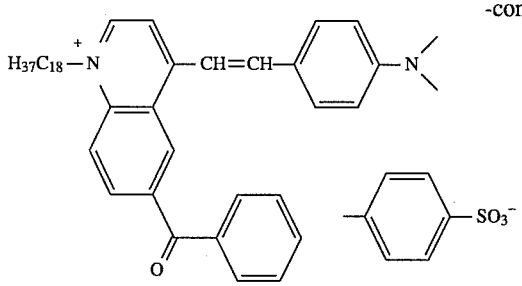

Cmpd #53

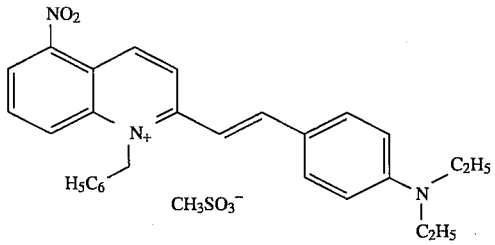

Compounds of the above structures can be prepared by a procedure similar to that for Cmpd #1 and Cmpd #2 as shown and described below.

Synthesis of Compounds 1 and 2:

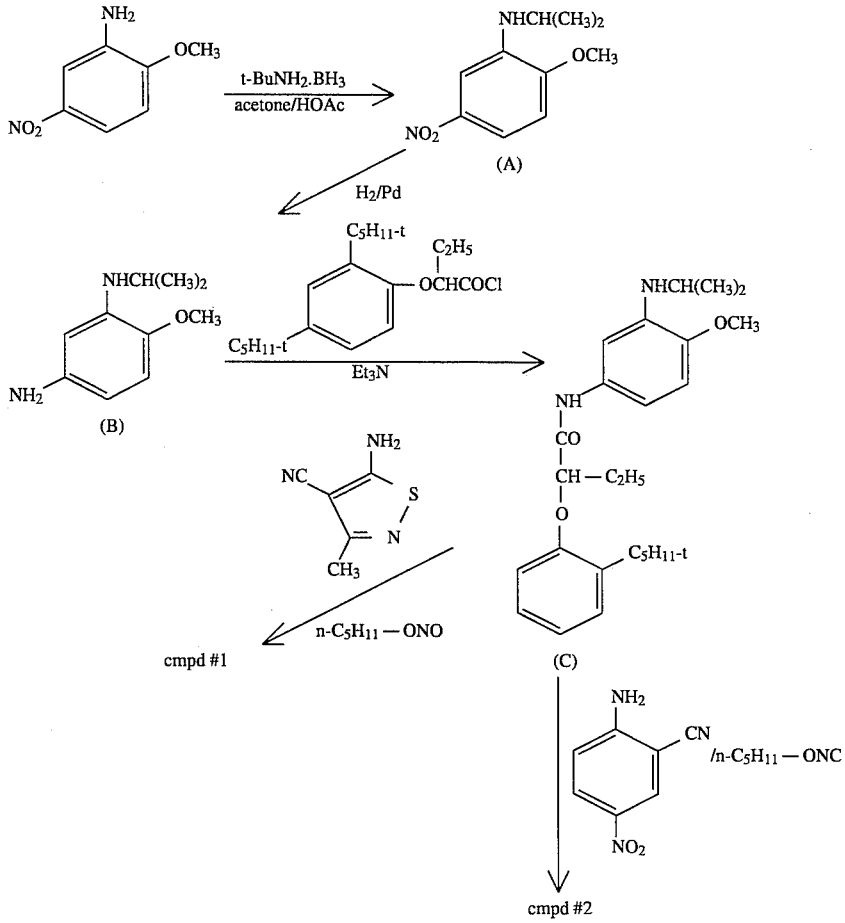

The procedure for the preparation of Cmpd #1 and Cmpd #2 was as follows. First, 2-amino-4-nitroanisole (36.6 g, 0.22 mole) was slurried with a mixture of acetone (75 mL) and acetic acid (75 mL) in a one-liter flask. Nineteen grams (0.21 mole) of t-butylaminoborane was added slowly before stirring the mixture overnight. The mixture was diluted with water to precipitate compound (A) which was filtered off, washed with water, and dried to 42.6 g (93%) of orange solid.

Nitro compound (A) (42.6 g, 0.2 mole) in tetrahydrofuran (300 mL) and 2 drops of trifluoroacetic acid was reduced with hydrogen over 10% platinum on charcoal catalyst at 3 atm pressure for 18 hr to afford the diamine (B) which was used immediately. The diamine solution was filtered to remove catalyst, concentrated in vacuo, concentrated again after addition of about 10 mL of toluene (to remove water), and redissolved in 350 mL of tetrahydrofuran (THF). Triethylamine (21 g, 0.21 mole) was added to the diamine solution before cooling the solution in an ice bath. Ballast acid chloride (2-di-t-pentylphenoxybutyryl chloride, 67.8 g, 0.2 mole in 20 mL THF) was added slowly with vigorous stirring. The mixture was allowed to warm to RT and diluted with 1.5 L of water. The precipitate was filtered off, washed with water, and dried. The crude solid was boiled with 500 mL of methanol and then cooled to obtain crystalline product (C). After washing with cold aqueous methanol (80% methanol) and drying, 81 g (84%) of compound (C) was obtained.

3-Methyl-4-cyano-5-aminoisothiazole (23.3 g, 0.17 mole) was stirred in a one-L flask with acetic acid (300 mL) and fluoroboric acid (84 mL of 50% aqueous solution). Pentyl nitrile (19.9 g, 0.17 mole) was added before warming the mixture to 40° for 5 min until the thiazole dissolved. The diazonium solution was then cooled to 0°. Coupler (C) (81 g, 0.17 mole) was mixed with THF (300 mL), acetic acid (200 mL), and water (40 mL) in a 5-L flask equipped with mechanical stirrer and immersed in an ice bath. The diazonium solution was added slowly portion-wise with concurrent addition of 100 g of ice and 84 g of sodium acetate. The mixture was stirred vigorously, allowed to come to room temperature ("RT"), and then diluted with 2 L of water to precipitate the dye as a gum. After decanting the aqueous layer, the gum was stirred with 500 mL of methanol to produce a granular solid. The solid was filtered off, redissolved in dichloromethane, and concentrated to a syrup. Crystalline dye (compound #1) (42.5 g, 40% yield) was obtained by stirring the syrup with methanol, cooling, filtering, and drying.

Compound #2 was obtained by the same procedure, except 2-cyano-4-nitroaniline was substituted for the isothiazole in the diazotization step. The reaction was run with 0.012 mole each of coupler (C) and aniline; 5.8 g (74%) of compound #2 was obtained after crystallization from methanol.

As already mentioned, the present invention provides a means to make developed negatives which contain magenta image-dyes with low absorption in the 560–590 nm range relative to magenta dyes formed by pyrazolotriazole or 1-phenyl-3-acylamino-5-pyrazolones, appear more like the latter developed negatives to any printer. Consequently, negatives of the present invention can contain any color coupler which forms a magenta dye with relatively low absorption in the 560–590 nm range upon reaction with oxidized color developer (for example, with a $D_{580}/D_{550}$ at a neutral midscale exposure of 0.8 or less). Negative elements of the present invention particularly contain as a magenta image dye-forming coupler, a 1-phenyl-3-anilino-5-pyrazolone color coupler (either 2 or 4 equivalent). Particularly, the 1-phenyl-3-anilino-5-pyrazolone color coupler may be of the following formula (I):

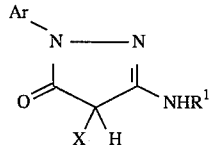

(I)

wherein:

Ar is an unsubstituted aryl group or an aryl group substituted with one or more substituents selected from halogen atoms and cyano, alkylsulfonyl, arylsulfonyl, sulfamoyl, sulfonamido, carbamoyl, carbonamido, alkoxy, acyloxy, aryloxy, alkoxycarbonyl, aryloxycarbonyl, ureido, nitro, alkyl, and trifluoromethyl, or Ar is an aryl group substituted with a group which forms a link to a polymeric chain;

$R^1$ is a substituted or unsubstituted phenyl group, the $R^1$ substituents being individually selected from halogen atoms, and alkyl, aryl, alkoxy, aryloxy, carbonamido, carbamoyl, sulfonamido, sulfamoyl, alkylsulfinyl, arylsulfinyl, alkylsulfonyl, arylsulfonyl, alkoxycarbonyl, aryloxycarbonyl, acyl, acyloxy, ureido, imido, carbamate, heterocyclic, cyano, trifluoromethyl, alkylthio, nitro, carboxyl and hydroxyl groups, provided that $R^1$ contains at least 6 carbon atoms or the $R^1$ substituents may individually comprise a group which forms a link to a polymeric chain; and X is hydrogen or a coupling-off group selected from the group consisting of halogens, alkoxy, aryloxy, alkylthio, arylthio, acyloxy, sulfonamido, carbonamido, arylazo, nitrogen-containing heterocyclic and imido groups.

Preferably, in the above formula (I):

Ar is of the structure:

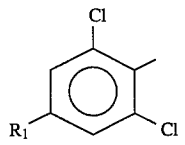

wherein $R_1$ is selected from the group consisting of halogen, cyano, alkylsulfonyl, arylsulfonyl, sulfamoyl, sulfonamido, carbamoyl, carbonamido, ureido, alkoxycarbonyl, aryloxycarbonyl, acyloxy, alkoxy, aryloxy, nitro and trifluoromethyl groups;

—$NHR_1$ is of the structure:

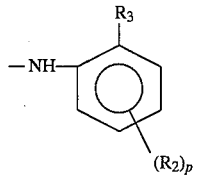

wherein p is from zero to 2 and each $R_2$ is in a meta or para position with respect to $R_3$;

each $R_2$ is individually selected from the group consisting of halogen, alkyl, alkoxy, aryloxy, carbonamido, carbamoyl, sulfonamido, sulfamoyl, alkylsulfinyl, arylsulfinyl, alkylsulfonyl, arylsulfonyl, alkoxycarbonyl, aryloxycarbonyl, acyloxy, ureido, imido, carbamate, heterocyclic, cyano, nitro, acyl, trifluoromethyl, alklythio and carboxyl groups; and $R_3$ is selected from the group consisting of hydrogen, halogen, alkyl, alkoxy, aryloxy, alkylthio, carbonamido, carbamoyl, sulfonamido, sulfamoyl, alkylsulfonyl, arylsulfonyl, alkoxycarbonyl, acyloxy, acyl, cyano, nitro and trifluoromethyl groups; and X is of the structure:

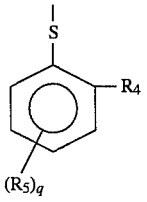

wherein $R_4$ and $R_5$ are individually selected from the group consisting of hydrogen, halogen, alkyl, alkoxy, aryloxy, carbonamido, ureido, carbamate, sulfonamido, carbamoyl, sulfamoyl, acyloxy, alkoxycarbonyl, aryloxycarbonyl, amino and carboxyl groups, and wherein q is 0, 1 or 2 and $R_5$ may be in the meta or para position with respect to the sulfur atom.

Couplers of the above type can be prepared by known methods, such as described in U.S. Pat. No. 4,855,441, UK 1 494 777, U.S. Pat. Nos. 4,555,479, 4,952,487, 4,585,728, 4,483,918, 4,929,540, 4,853,319, 4,585,728, EP 0 257 451, U.S. Pat. Nos. 4,952,487, 4,351,897.

Some particular examples of the foregoing coupler types which can be used in the negatives of the present invention, are given below:

COUPLER I-1

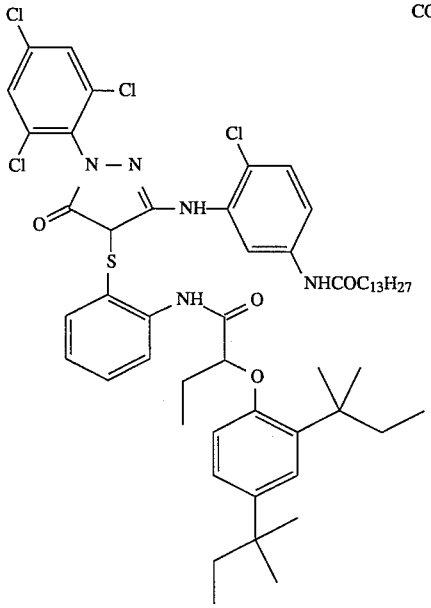

-continued

I-2

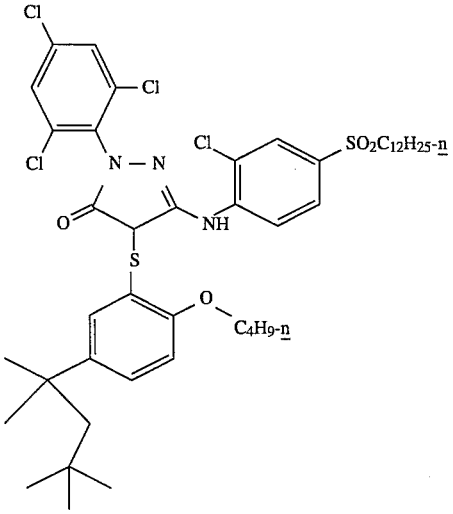

I-3

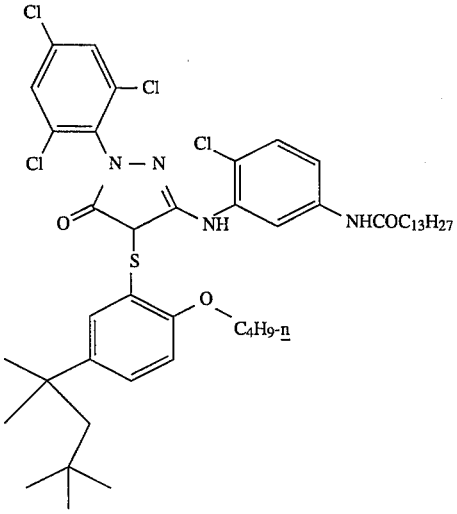

I-4

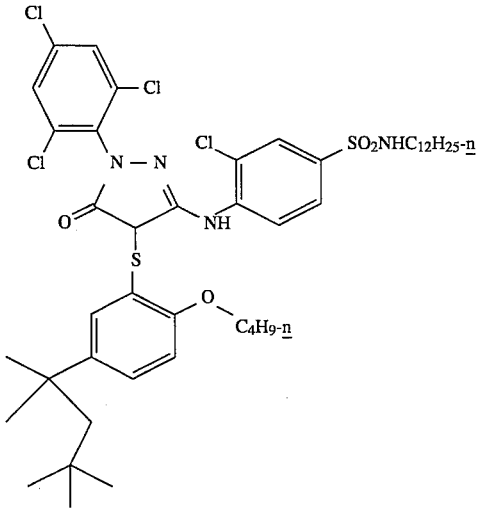

-continued

I-5

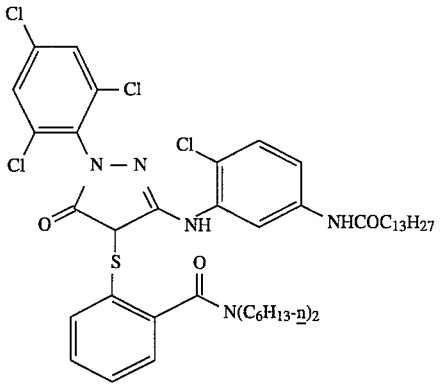

I-6

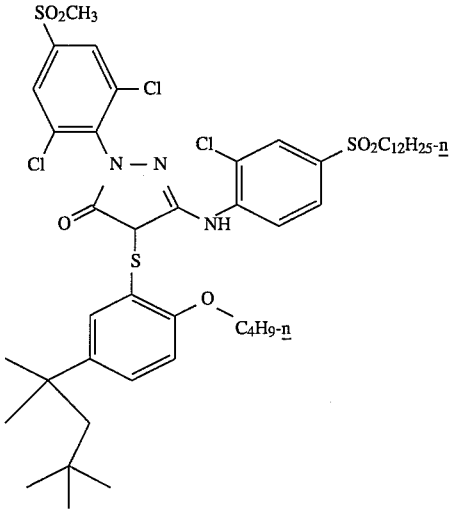

I-7

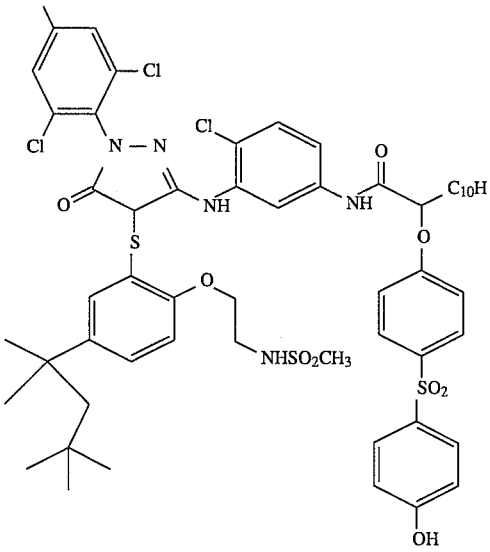

-continued

I-8

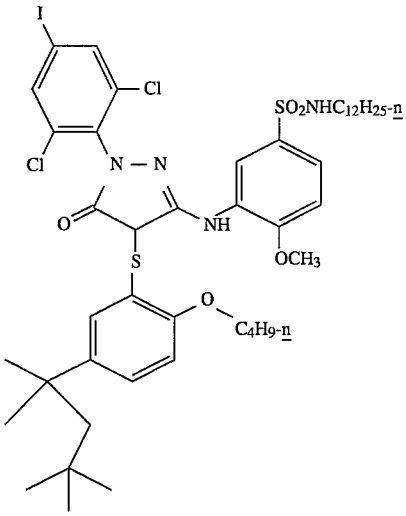

COUPLER I-9

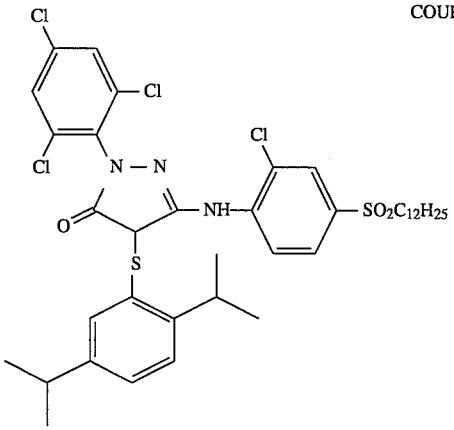

As to the magenta coupler, particularly those magenta couplers of formula (I) above, the level would typically be 0.01 to 5 g/m$^2$ of coupler, or 0.02 to 2 g/m$^2$, or more typically 0.05 to 1 g/m$^2$.

The light sensitive material used in the negative elements of the present invention can include any of silver bromide, silver iodobromide, silver iodochlorobromide, silver chlorobromide and silver chloride.

Although the mean grain size of silver halide particles in the photographic emulsion is not particularly limited, it is preferably 6 μm or less. The mean grain size is obtained from the grain diameter in those particles which are spherical or nearly spherical, an edge length for those particles which are cubic, and an equivalent circular diameter calculated from projected areas for those that are plate-like or tabular. The grain size of the silver halide may have any distribution known to be useful in photographic compositions, and may be either polydispersed or monodispersed.

Silver halide particles in the photographic emulsion may have a regular crystal structure, e.g., a cubic or octahedral structure, an irregular crystal structure, e.g., a spherical or plate-like structure, or a composite structure thereof. In addition, silver halide particles composed of those having different crystal structures, including tabular grains, may be used. For the purposes of the present application, a tabular grain emulsion means that the emulsion grains have two essentially flat parallel faces that account for most of the surface area. In addition, greater than 50 percent of the total projected area of the emulsion grains are accounted for by tabular grains having a thickness of less than 0.3 μm (0.5 μm for blue sensitive emulsion) and an average tabularity (T) of greater than 25 (preferably greater than 100), where the term "tabularity" is employed in its art recognized usage as $$T=ECD/t^2$$

where

ECD is the average equivalent circular diameter of the tabular grains in μm and t is the average thickness in μm of the tabular grains.

Tabular grain emulsions suitable for the present invention are disclosed by Wey U.S. Pat. No. 4,399,215; Kofron U.S. Pat. No. 4,434,226; Maskasky U.S. Pat. No. 4,400,463; and Maskasky U.S. Pat. No. 4,713,323; as well as disclosed in allowed U.S. applications: Ser. Nos. 819,712 (filed Jan. 13, 1992), 820,168 (filed Jan. 13, 1992), 762,971 (filed Sep. 20, 1991), 763,013 (filed Jan. 13, 1992), and pending U.S. application Ser. No. 763,030 (filed Sep. 20, 1992).

The tabular emulsion may be of any halide type, for example, chloride, chlorobromide, bromide, bromoiodide, or chlorobromoiodide; but preferably will be silver bromide or silver bromoiodide, including structured iodide.

The silver halide grains to be used in the invention may be prepared according to methods known in the art, such as those described in *Research Disclosure*, (Kenneth Mason Publications Ltd, Emsworth, England) Item 308119, December, 1989 (hereinafter referred to as *Research Disclosure I*) and James, *The Theory of the Photographic Process*. These include methods such as ammoniacal emulsion making, neutral or acid emulsion making, and others known in the art. These methods generally involve mixing a water soluble silver salt with a water soluble halide salt in the presence of a protective colloid, and controlling the temperature, pAg, pH values, etc, at suitable values during formation of the silver halide by precipitation.

The silver halide used in the photographic elements of the present invention can also be spectrally sensitized with methine dyes or other dyes. Suitable dyes which can be employed include cyanine dyes, merocyanine dyes, complex cyanine dyes, complex merocyanine dyes, homopolar cyanine dyes, hemicyanine dyes, styryl dyes, and hemioxonol dyes. Of these dyes, cyanine dyes, merocyanine dyes and complex merocyanine dyes are particularly useful.

Any conventionally utilized nuclei for cyanine dyes are applicable to these dyes as basic heterocyclic nuclei. That is, a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, a pyridine nucleus, etc., and further, nuclei formed by condensing alicyclic hydrocarbon rings with these nuclei and nuclei formed by condensing aromatic hydrocarbon rings with these nuclei, that is, an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus, a quinoline nucleus, etc., are appropriate. The carbon atoms of these nuclei can also be substituted.

The merocyanine dyes and the complex merocyanine dyes that can be employed contain 5- or 6-membered heterocyclic nuclei such as pyrazolin-5-one nucleus, a thiohydantoin nucleus, a 2-thioxazolidin-2,4-dione nucleus, a thiazolidine-2,4-dione nucleus, a rhodanine nucleus, a thiobarbituric acid nucleus, and the like.

These sensitizing dyes can be employed individually, and can also be employed in combination. A combination of sensitizing dyes is often used particularly for the purpose of supersensitization.

The sensitizing dyes may be present in the emulsion together with dyes which themselves do not give rise to spectrally sensitizing effects but exhibit a supersensitizing effect or materials which do not substantially absorb visible light but exhibit a supersensitizing effect. For example, aminostilbene compounds substituted with a nitrogen-containing heterocyclic group (e.g., those described in U.S. Pat. Nos. 2,933,390 and 3,635,721), aromatic organic acid-formaldehyde condensates (e.g., those described in U.S. Pat. No. 3,743,510), cadmium salts, azaindene compounds, and the like, can be present.

The silver halide to be used in the invention may be advantageously also be subjected to chemical sensitization using compounds and techniques known in the art, such as described in *Research Disclosure I* and the references cited therein. In addition, the methods as described in H. Frieser ed., *Die Grundlagen Der Photographischen Prozesse mit Silberhalogeniden, Akademische Verlagsgesellschaft*, pages 675 to 734 (1968) can also be used for chemical sensitization. Namely, a sulfur sensitization process using active gelatin or compounds (e.g., thiosulfates, thioureas, mercapto compounds and rhodanines) containing sulfur capable of reacting with silver; a reduction sensitization process using reducing substances (e.g., stannous salts, amines, hydrazine derivatives, formamidinesulfinic acid and silane compounds); a noble metal sensitization process using noble metal compounds (e.g., complex salts of Group VIII metals in the Periodic Table, such as Pt, Ir and Pd, etc., as well as gold complex salts); and so forth can be applied alone or in combination with each other. Other useful sensitization means include sensitization by rapid sulfur sensitizers (DCT) such as disclosed in U.S. Pat. No. 4,810,626, or by gold complexes as described in U.S. Pat. Nos. 5,049,485 and 5,049,484. Chemical sensitization is generally carried out at pAg levels of from 5 to 10, pH levels of from 3 to 8, and temperatures of from 30 to 80° C., as illustrated in *Research Disclosure*, June 1975, item 13452 and U.S. Pat. No. 3,772,031.

The photographic elements of the present invention, as is typical, provide the silver halide in the form of an emulsion. Photographic emulsions generally include a vehicle for coating the emulsion as a layer of a photographic element. Useful vehicles include both naturally occurring substances such as proteins, protein derivatives, cellulose derivatives (e.g., cellulose esters), gelatin (e.g., alkali-treated gelatin such as cattle bone or hide gelatin, or acid treated gelatin such as pigskin gelatin), gelatin derivatives (e.g., acetylated gelatin, phthalated gelatin, and the like), and others as described in *Research Disclosure I*. Also useful as vehicles or vehicle extenders are hydrophilic water-permeable colloids. These include synthetic polymeric peptizers, carriers, and/or binders such as poly(vinyl alcohol), poly(vinyl lactams), acrylamide polymers, polyvinyl acetals, polymers of alkyl and sulfoalkyl acrylates and methacrylates, hydrolyzed polyvinyl acetates, polyamides, polyvinyl pyridine, methacrylamide copolymers, and the like, as described in *Research Disclosure I*. The vehicle can be present in the emulsion in any amount useful in photographic emulsions. The emulsion can also include any of the addenda known to be useful in photographic emulsions.

The photographic emulsion used in the present invention may include various compounds for the purpose of preventing fog formation or of stabilizing photographic performance in the photographic light sensitive material during the production, storage or photographic processing thereof. For example, those compounds known as antifoggants or stabilizers can include azoles such as benzothiazolium salts; nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles (particular 1-phenyl-5-mercaptotetrazole), and the like.; mercaptopyrimidines; mercaptotriazines; thioketo compounds such as oxazolinethione, and the like.; azaindenes such as triazaindenes, tetraazaindenes (particularly 4-hydroxysubstituted (1,3,3a,7)tetraazaindenes), pentaazaindenes, etc.; benzenethiosulfonic acids; benzenesulfinic acids; benzenesulfonic amides; aryl thiosulfonates and the like as stabilizers or antifoggants. Disulfide antifoggants may also be used.

Other addenda in the emulsion may include oxidized developer scavengers and filter dyes (including solid particle filter dyes) such as described in U.S. Pat. Nos. 4,855,221; 4,857,446; 4,988,611; 4,900,653; 4,948,717, 4,948,718, 4,950,586; and 4,940,654. Further addenda include light absorbing or reflecting pigments, vehicle hardeners such as gelatin hardeners, coating aids, and development modifiers such as development inhibitor releasing (DIR) couplers, timed development inhibitor releasing couplers, ultraviolet absorbers, bleach accelerators, and the like. These addenda and methods of their inclusion in emulsion and other photographic layers are well-known in the art and are disclosed in *Research Disclosure I* and the references cited therein. The emulsion may also include brighteners, such as stilbene brighteners. Such brighteners are well-known in the art.

The green sensitive emulsion layer can be coated simultaneously or sequentially with other emulsion layers, subbing layers, filter dye layers, interlayers, or overcoat layers, all of which may contain various addenda known to be included in photographic elements such as described above. It will be appreciated that the green, red and blue sensitive records or any of them can consist of one or more layers of which differ in speed.

The layers of the photographic negative element can be coated onto a transparent support using techniques well-known in the art. These techniques include immersion or dip coating, roller coating, reverse roll coating, air knife coating, doctor blade coating, stretch-flow coating, and curtain coating, to name a few. The coated layers of the element may be chill-set or dried, or both. Drying may be accelerated by known techniques such as conduction, convection, radiation heating, or a combination thereof.

The dye forming couplers are provided in their respective emulsions typically by first dissolving or dispersing them in a water immiscible, high boiling point organic solvent, the resulting mixture then being dispersed in the emulsion. Suitable solvents include those in European Patent Application 87119271.2. Various dye-forming couplers are well-known in the art and are disclosed, for example, in *Research Disclosure I*. However, as already mentioned, the negative elements of the present invention are those which have a color coupler in a green sensitive layer which upon reaction with oxidized color developer, produce magenta dyes with relatively low density in the 560–590 nm range.

Photographic elements of the present invention may also usefully include a magnetic recording material as described in *Research Disclosure*, Item 34390, November 1992.

Photographic elements comprising the composition of the invention can be processed in any of a number of well-known photographic processes utilizing any of a number of well-known processing compositions, described, for example, in *Research Disclosure I*, or in James, *The Theory of the Photographic Process* 4th, 1977. Such processing further includes rapid processing of the type described in, for example, U.S. Pat. No. 4,892,804.

The invention is illustrated further in the following Examples. All silver halide emulsion particle sizes given are average figures obtained by disc centrifuge, unless otherwise indicated.

EXAMPLE 1

To demonstrate the effect of an inert dye in a simple bilayer format, various bilayer photographic elements were prepared as indicated in Table 1 below. Each element was prepared by coating a cellulose acetate-butyrate clear film support with a first layer containing gelatin at 0.65 g/m$^2$ and, when present, an inert dye (DYE-1 or DYE-2) dispersed in 4 times its weight of tricresylphosphate at 0.054 g/m$^2$. This was then overcoated with a photosensitive second layer containing gelatin at 3.77 g/m$^2$ and, when present, a green sensitized silver bromoiodide emulsion at 1.08 g/m$^2$. In some of the samples, as indicated in Table 1, a magenta image coupler (Compound A, I-1 or C) was provided in a corresponding dispersion as described below, dispersed in the second layer at 0.31 mmol/m$^2$. The first and second layers were then overcoated with a layer containing 1.08 g/m$^2$ of gelatin and bis-vinylsulfonyl methyl ether hardener at 1.75% weight percent based on total gel.

Samples of each element were then exposed imagewise through a stepped density test object and subjected to the KODAK FLEXICOLOR (C41) process as described in *British Journal of Photography Annual*, 1988, pp 196–198. Density and spectrophotographic measurements were taken at the indicated wavelength and exposure values. The "toe" was read at the exposure point at +0.15 density above Dmin; "midscale" at +0.7 log E over toe; and the "shoulder" at +1.4 log E over toe. Structures of DYE-1 and DYE-2, and Couplers A, and C, are provided below (the structure for coupler I-1 was provided previously). The coupler dispersions are also described below. The results from the foregoing measurements are provided in Table 1 below.

Coupler A

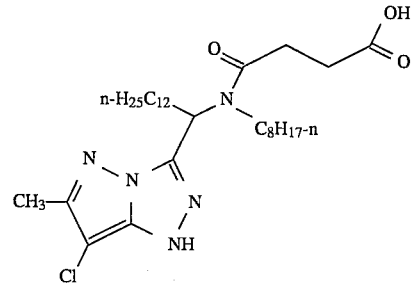

Coupler A was dispersed in 50% its weight of 2,4-bis(1,1-dimethylpropyl)-phenol and 50% its weight in oleyl alcohol.

Coupler I-1 was dispersed in 70% of its weight of tricresylphosphate and 30% of N,N-dibutyl-2-butyloxy-5-tert-amylaniline.

COUPLER C

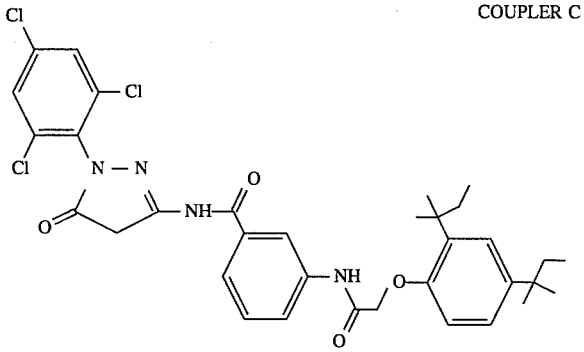

Coupler C was dispersed in its own weight of tricresylphosphate.

DYE-1

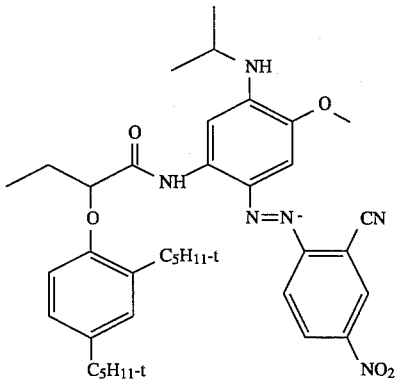

DYE-2

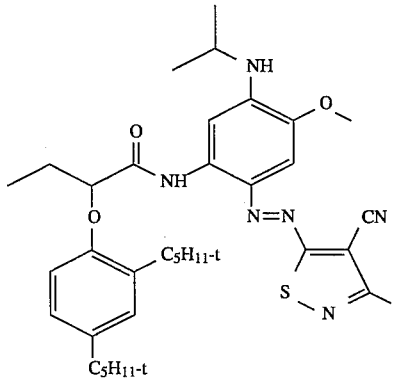

TABLE 1

HUE COMPARISON OF IMAGE COUPLERS WITH INERT DYES

| Coupler | Exposure | λmax | HBM | D580/D550 | D640/D550 |
|---|---|---|---|---|---|
| A | | 558 | 95 | .808 | .096 |
| C | | 555 | 98 | .818 | .148 |
| DYE-2 Only | | 581 | 124 | | |
| DYE-1 Only | | 579 | 131 | | |
| I-1 Only | | 544 | 82 | .470 | .076 |
| I-1 + DYE-2 | Toe | 547 | 101 | .696 | .133 |
| I-1 + DYE-2 | Midscale | 545 | 92 | .611 | .096 |

TABLE 1-continued

HUE COMPARISON OF IMAGE COUPLERS WITH INERT DYES

| Coupler | Exposure | λmax | HBM | D580/D550 | D640/D550 |
|---|---|---|---|---|---|
| I-1 + DYE-2 | Shoulder | 544 | 92 | .600 | .091 |
| I-1 + DYE-1 | Toe | 555 | 128 | .814 | .353 |
| I-1 + DYE-1 | Midscale | 547 | 93 | .622 | .178 |
| I-1 + DYE-1 | Shoulder | 545 | 93 | .609 | .162 |

λmax = Wavelength at maximum absorbance
HBW = Width (in nm) of dye curve at ½ maximum absorbance It will be appreciated that in Table 1, the ratio of density at 580 nm to density at 550 nm is a measure of the apparent broadening in the hue of a 1-phenyl- 3-anilino-5-pyrazolone coupler. As can be seen from the results in Table 1, the addition of either dye DYE-2 or DYE-1 causes the overall apparent hue to be more like that of the dye formed (after development) from Coupler A or Coupler C than that formed from Coupler I-1 alone. Because DYE-1 and DYE-2 are photographically inert, the effect is larger in the toe than in the shoulder. As described above, the inert dyes should have low absorbance in the red region, as shown by the $D_{640}/D_{550}$ ratio. Note the relatively low red absorbance of DYE-1 and DYE-2 as shown by the foregoing ratio in Table 1.

EXAMPLE 2

Multilayer negative films Samples 1 through 3, were obtained or prepared as described below:

Sample 1

Commercially available KODAK Gold 100 Plus (manufactured by Eastman Kodak Company, Rochester, N.Y.). This film contains Coupler A (see Example 1 above) as the magenta image dye forming pyrazolotriazole coupler.

Sample 2

A multilayer photographic film element of Sample 2 was prepared by coating a cellulose triacetate film support with the following layers in sequence (coverages are in grams per meter squared; structure of magenta coupler I-1 was provided earlier):

Layer 1 (Antihalation layer): black colloidal silver sol containing 0.151 g of silver, cyan dye material CD-1 (0.032), magenta dye material MD-1 (0.043), yellow dye material YD-1 (0.101) and gelatin (2.44) were contained in this layer.

Layer 2 (Lowest Sensitivity Red-sensitive layer): This layer comprised a blend of a red-sensitized, tabular grain silver iodobromide emulsion (1.3% iodide, 0.50 microns diameter by 0.08 microns thick) (0.463) and a red-sensitized tabular grain silver iodobromide emulsion (4.5% iodide, 1.00 microns diameter by 0.09 microns thick) (0.473). A cyan dye-forming coupler C-1 (0.54) and a BAR coupler B-1 (0.04) were incorporated in this layer. Gelatin was also included (1.78).

Layer 3 (Medium Sensitivity Red-sensitive layer): This layer comprised a red-sensitized, tabular grain, silver iodobromide emulsion (4.5% iodide, 1.31 diameter by 0.12 microns thick) (0.70). This layer also comprised a cyan dye-forming coupler C-1 (0.23), a cyan dye-forming masking coupler CM-1 (0.022), DIR coupler D-1 (0.011). Gelatin (1.66) was included.

Layer 4 (Highest Sensitivity Red-sensitive layer): This layer comprised a red-sensitized, tabular grain, silver iodobromide emulsion (4.5% iodide, 2.70 diameter by 0.13 microns thick) (1.08). This layer also comprised a cyan dye-forming coupler C-1 (0.124), a cyan dye-forming masking coupler CM-1 (0.032), DIR coupler D-2 (0.05) and DIR coupler D-1 (0.024). Gelatin (1.36) was included.

Layer 5 (Interlayer): This layer comprised gelatin (1.29).

Layer 6 (Lowest Sensitivity Green-sensitive layer): This layer comprised a blend of a green-sensitized, tabular grain, silver iodobromide emulsion (1.3% iodide, 0.54 microns diameter by 0.08 microns thick) (0.602) and a green-sensitized, tabular grain, silver iodobromide emulsion (4.5% iodide, 1.03 microns diameter by 0.09 microns thick) (0.3). This layer also comprised a magenta dye-forming coupler I-1 (0.24). The layer also incorporated a masking coupler MM-1 (0.65) and gelatin (1.78).

Layer 7 (Medium Sensitivity Green-sensitive layer): This layer comprised a green-sensitized, tabular grain, silver iodobromide emulsion (4.5% iodide, 1.22 microns diameter by 0.11 microns thick) (0.97), a magenta dye-forming coupler I-1 (0.10), and a magenta dye-forming masking coupler MM-1 (0.064). This layer also incorporated DIR coupler D-1 (0.024) and gelatin (1.48).

Layer 8 (Highest Sensitivity Green-sensitive layer): This layer comprised a green-sensitized, tabular grain, silver iodobromide emulsion (4.5% iodide, 2.23 microns diameter by 0.13 microns thick) (0.97), a magenta dye-forming coupler I-1 (0.07) and a magenta dye-forming masking coupler MM-1 (0.054). This layer also incorporated DIR coupler D-3 (0.01), masking coupler MM-1 (0.054), DIR coupler D-4 (0.008) and gelatin (1.33).

Layer 9 (Yellow filter layer): This layer comprised yellow dye material YD-2 (0.11) and gelatin (1.33).

Layer 10 (Lowest Sensitivity Blue-sensitive layer): This layer comprised a blend of a blue-sensitized, tabular grain silver iodobromide emulsion (4.5% iodide, 1.02 micron diameter by 0.09 micron thick) (0.24) and a blue-sensitized, tabular grain, silver iodobromide emulsion (4.5% iodide, 1.38 microns diameter by 0.11 microns thick) (0.59). This layer incorporated a yellow dye-forming coupler Y-1 (0.70), yellow coupler Y-2 (0.28), DIR coupler D-5 (0.06), and BAR coupler B-1 (0.003), cyan coupler C-1 (0.016), and gelatin (2.60).

Layer 11 (Highest Sensitivity Blue-sensitive layer): This layer comprised a blue-sensitized, conventional 3-D grain, silver iodobromide emulsion (12% iodide, 1.0 micron) (0.22) and a blue-sensitized, tabular grain, silver iodobromide emulsion (4.5% iodide, 3.53 microns diameter by 0.14 microns thick) (0.57). This layer also incorporated yellow dye-forming coupler Y-1 (0.22), yellow coupler Y-2 (0.087), DIR D-5 (0.049), BAR B-1 (0.005), cyan coupler C-1 (0.021), and gelatin (1.97).

Layer 12 (UV filtration layer): This layer comprised dye UV-1 (0.11), UV-2 (0.11), and unsensitized silver bromide Lippman emulsion (0.22). Gelatin was included (1.11).

Layer 13 (Protective layer): This layer comprised gelatin (0.92) and matte polymethylmethacrylate beads (0.054).

This film was hardened at coating with 1.75% by weight of total gelatin of hardener H-1. Surfactants, coating aids, oxidized developer scavengers, soluble absorber dyes and stabilizers were added to the various layers of this sample as is commonly practiced in the art.

C-1:

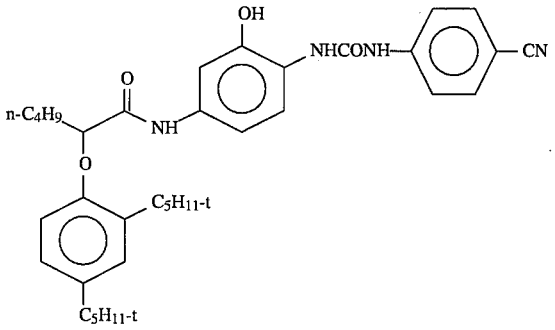

CM-1

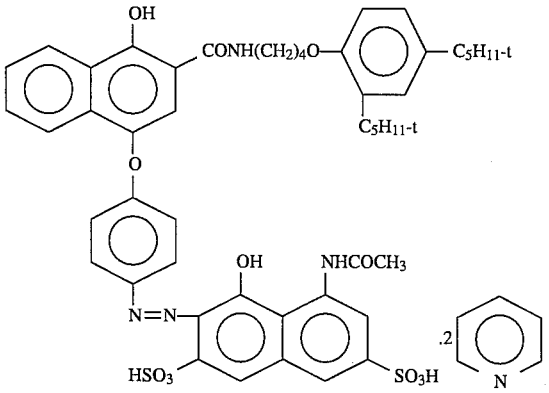

B-1

-continued
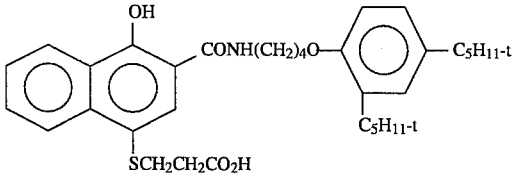
MD-1
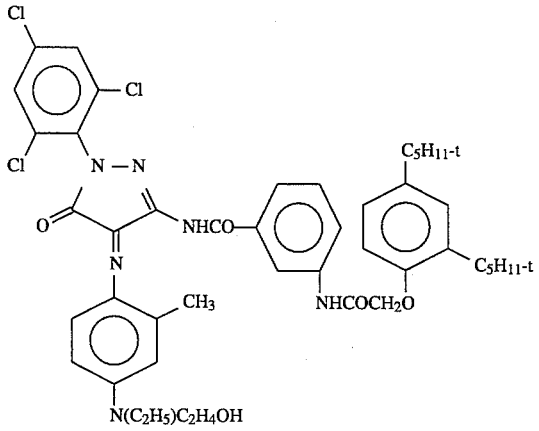
D-1
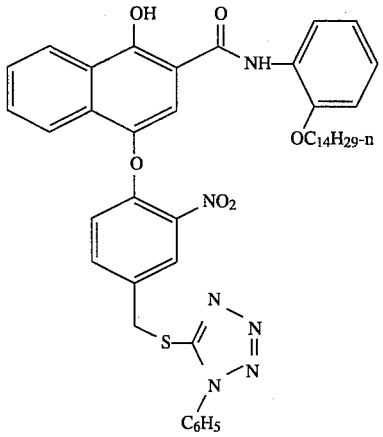
D-2
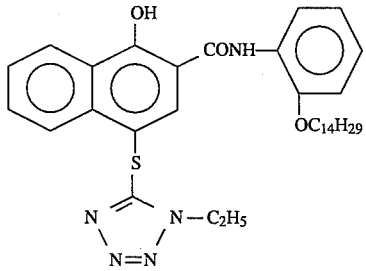
D-3:

-continued
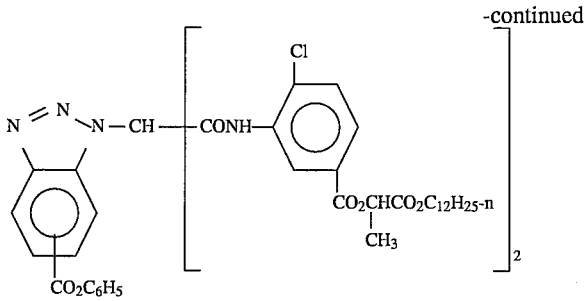
D-4:
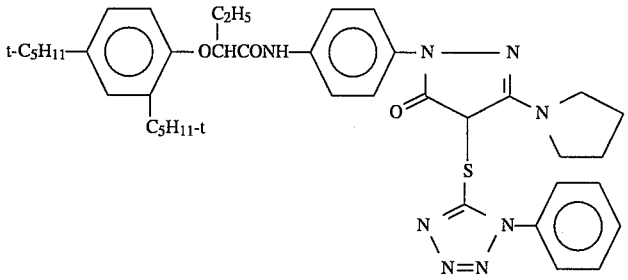
D-5
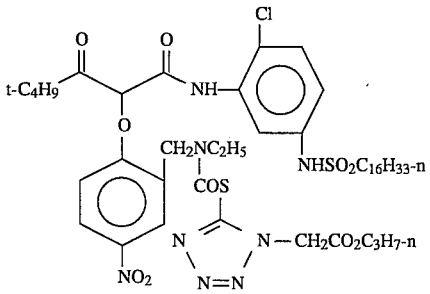
MM-1
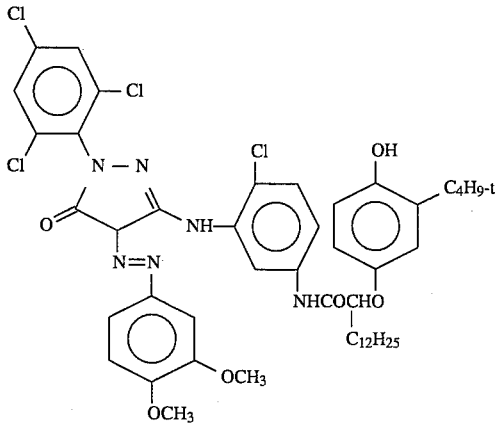
Y-1:

-continued
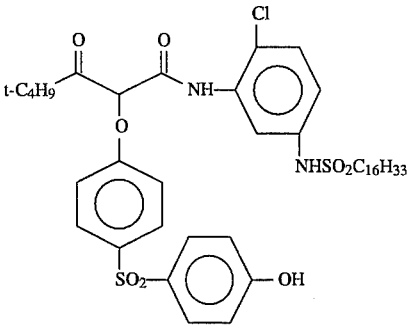
Y-2
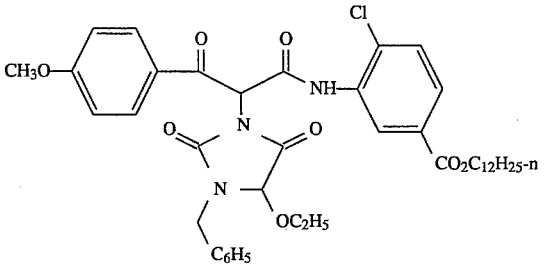
YD-1:
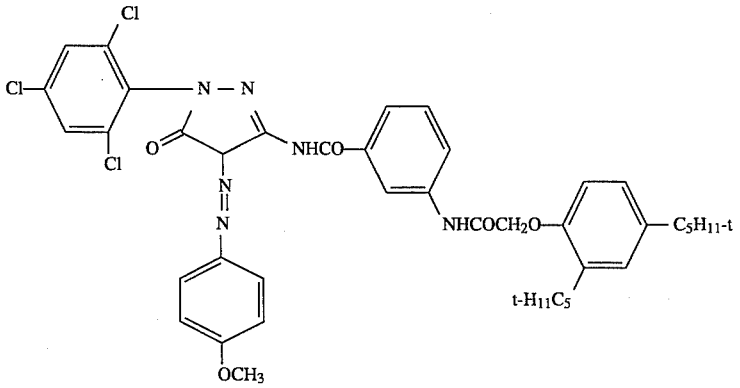
YD-2:
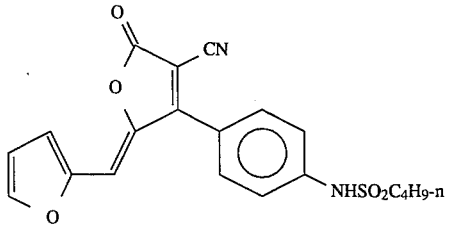
UV-1:
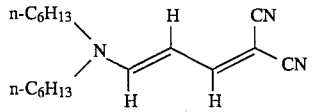
UV-2:

-continued

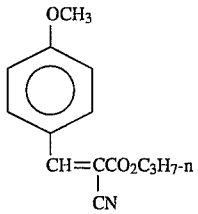

H-1:
$CH_2(SO_2CH{=}CH_2)_2$

CD-1:

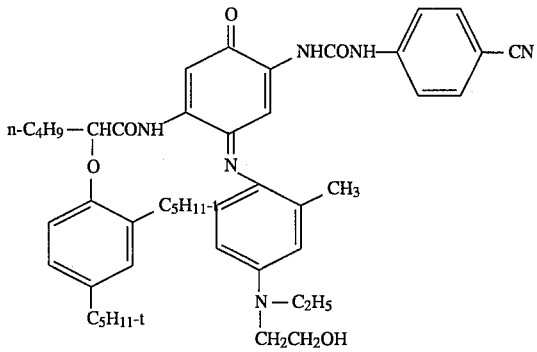

Sample 3

Sample 3 was prepared as described for Sample 2 except MD-1, located in Layer 1, was replaced by the inert dye DYE-2 (0.043 g/m$^2$) to produce a multilayer negative element of the present invention.

Samples of each multilayer film element were exposed with white light imagewise through a stepped density test object and subjected to the KODAK FLEXICOLOR (C41) process as described previously. The $D_{580}/D_{550}$ results measured at the average normal exposure for a properly exposed negative, (midscale exposure) are summarized in Table 2 below.

TABLE 2

IMPROVED PRINTER COMPATIBILITY BETWEEN FILMS WITH PYRAZOLOTRIAZOLE COUPLERS OR PYRAZOLONE COUPLER WITH COLORANT

| Sample | Magenta Dye Forming Coupler | $D_{580}/D_{550}$ |
|---|---|---|
| 1 | Pyrazolotriazole (Coupler A) | 0.654 |
| 2 | Pyrazolone (Coupler I-1) | 0.625 |
| 3 | Pyrazolone (Coupler I-1) + Dye-2 | 0.655 |

Table 2 demonstrates that multilayer films containing a pyrazolone coupler in the green sensitive layer provide less density at 580 nm relative to density at 550 nm, than do films containing a pyrazolotriazole coupler. Thus, printers which read significant amounts of green density at wavelengths greater than 560 nm would measure films of Samples 1 and 2 as having different amounts of green density even though they have the same amount of green density at 550 nm. However, Sample 3 (a film of the present invention) which includes both an inert dye and the pyrazolone coupler, has a higher density at 580 nm thereby making such a film appear more like a film of Sample 1 even in a wide range of printers (particularly those which read significant green density above 560 nm).

Experiments with KODAK Models 2610 and 3510 printers, which do not significantly read green densities greater than 560 nm, showed that Samples 1, 2, and 3 all had approximately the same red, green and blue density readings. However, KODAK Model 35 or the NORITSU 1001 Minilab Printers, which read significant amounts of green density above 560 nm, found that Samples 1 and 3 were closer in red, green and blue response than Samples 1 and 2, and would have produced prints from Samples 1 and 3 much closer in color balance than from Samples 1 and 2.

The present invention has been described in detail with particular reference to preferred embodiments, but it will be understood that variations and modifications can be effected within the spirit and scope of the invention.

What is claimed is:

1. A silver halide photographic negative comprising a red sensitive silver halide emulsion layer containing a coupler which reacts with oxidized color developer to form a cyan dye, a blue sensitive silver halide emulsion layer containing a coupler which reacts with oxidized color developer to form a yellow dye, and a green sensitive silver halide emulsion layer containing a color coupler which upon reaction with oxidized color developer forms a magenta image dye, the negative additionally comprising a non-diffusible inert dye having a peak absorption between 560–590 nm so that the negative has a $D_{580}/D_{550}$ which is greater than exhibited by the negative absent the inert dye.

2. A silver halide photographic negative according to claim 1 wherein the negative, absent the inert dye, has a $D_{580}/D_{550}$ at neutral midscale exposure of 0.75 or less.

3. A silver halide photographic negative according to claim 1 wherein the negative, absent the inert dye, has a $D_{580}/D_{550}$ at neutral midscale exposure of 0.60 or less.

4. A silver halide photographic negative according to claim 1 wherein the inert dye increases $D_{580}/D_{550}$ of the negative at neutral midscale exposure by at least 0.01.

5. A silver halide photographic negative according to claim 1 wherein the inert dye increases $D_{580}/D_{550}$ of the negative at neutral midscale exposure by at least 0.05.

6. A silver halide photographic negative according to claim 4 wherein any increase in $D_{640}/D_{550}$ of the negative at neutral midscale exposure caused by the inert dye, is less than the amount the inert dye increases $D_{580}/D_{550}$ of the negative at neutral midscale exposure.

7. A silver halide color photographic negative comprising a red sensitive silver halide emulsion layer containing a coupler which reacts with oxidized color developer to form a cyan dye, a blue sensitive silver halide emulsion layer containing a coupler which reacts with oxidized color developer to form a yellow dye, and a green sensitive silver halide emulsion layer containing a 1-phenyl-3-anilino-5-pyrazolone containing color coupler which upon reaction with oxidized color developer forms a magenta image dye, the negative additionally comprising a non-diffusible inert dye having a peak absorption between 560–590 nm so that the negative has a $D_{580}/D_{550}$ at neutral midscale exposure which is greater than exhibited by the negative absent the inert dye.

8. A silver halide photographic negative according to claim 7 wherein the negative, absent the inert dye, has a $D_{580}/D_{550}$ at neutral midscale exposure of 0.75 or less.

9. A silver halide photographic negative according to claim 7 wherein the negative, absent the inert dye, has a $D_{580}/D_{550}$ at neutral midscale exposure of 0.60 or less.

10. A silver halide photographic negative according to claim 7 wherein the inert dye increases $D_{580}/D_{550}$ of the negative at neutral midscale exposure by at least 0.01.

11. A silver halide photographic negative according to claim 7 wherein the inert dye increases $D_{580}/D_{550}$ of the negative at neutral midscale exposure by at least 0.05.

12. A silver halide photographic negative according to claim 10 wherein any increase in $D_{640}/D_{550}$ of the negative at neutral midscale exposure caused by the inert dye, is less than the amount the inert dye increases $D_{580}/D_{550}$ of the negative at neutral midscale exposure.

13. A silver halide photographic negative according to claim 7 wherein the inert dye is located below all green sensitive layers in the negative.

14. A silver halide color photographic negative comprising:

a red sensitive silver halide emulsion layer containing a coupler which reacts with oxidized color developer to form a cyan dye, a blue sensitive silver halide emulsion layer containing a coupler which reacts with oxidized color developer to form a yellow dye, and a green sensitive silver halide emulsion layer containing a color coupler which upon reaction with oxidized color developer forms a magenta image dye, the color coupler being of the formula:

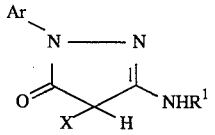

Ar is an unsubstituted aryl group or an aryl group substituted with one or more substituents selected from halogen atoms and cyano, alkylsulfonyl, arylsulfonyl, sulfamoyl, sulfonamido, carbamoyl, carbonamido, alkoxy, acyloxy, aryloxy, alkoxycarbonyl, aryloxycarbonyl, ureido, nitro, alkyl, and trifluoromethyl, or Ar is an aryl group substituted with a group which forms a link to a polymeric chain;

$R^1$ is a substituted or unsubstituted phenyl group, the $R^1$ substituents being individually selected from halogen atoms, and alkyl, aryl, alkoxy, aryloxy, carbonamido, carbamoyl, sulfonamido, sulfamoyl, alkylsulfinyl, arylsulfinyl, alkylsulfonyl, arylsulfonyl, alkoxycarbonyl, aryloxycarbonyl, acyl, acyloxy, ureido, imido, carbamate, heterocyclic, cyano, trifluoromethyl, alkylthio, nitro, carboxyl and hydroxyl groups, provided that $R^1$ contains at least 6 carbon atoms or the $R^1$ substituents may individually comprise a group which forms a link to a polymeric chain;

X is hydrogen or a coupling-off group selected from the group consisting of halogens, alkoxy, aryloxy, alkylthio, arylthio, acyloxy, sulfonamido, carbonamido, nitrogen-containing heterocyclic and imido groups; and the negative additionally comprising a non-diffusible inert dye having a peak absorption between 560–590 nm so that the negative has a $D_{580}/D_{550}$ at neutral midscale exposure which is greater than exhibited by the negative absent the inert dye.

15. A photographic negative according to claim 14 in which Ar is of the structure:

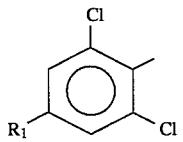

wherein $R_1$ is selected from the group consisting of halogen, cyano, alkylsulfonyl, arylsulfonyl, sulfamoyl, sulfonamido, carbamoyl, carbonamido, ureido, alkoxycarbonyl, aryloxycarbonyl, acyloxy, alkoxy, aryloxy, nitro and trifluoromethyl groups;

$—NHR^1$ is of the structure:

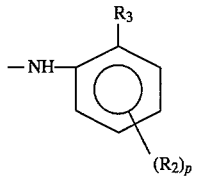

wherein p is from zero to 2 and each $R_2$ is in a meta or para position with respect to $R_3$;

each $R_2$ is individually selected from the group consisting of halogen, alkyl, alkoxy, aryloxy, carbonamido, carbamoyl, sulfonamido, sulfamoyl, alkylsulfinyl, arylsulfinyl, alkylsulfonyl, arylsulfonyl, alkoxycarbonyl, aryloxycarbonyl, acyloxy, ureido, imido, carbamate, heterocyclic, cyano, nitro, acyl, trifluoromethyl, alklythio and carboxyl groups; and $R_3$ is selected from the group consisting of hydrogen, halogen, alkyl, alkoxy, aryloxy, alkylthio, carbonamido, carbamoyl, sulfonamido, sulfamoyl, alkylsulfonyl, arylsulfonyl, alkoxycarbonyl, acyloxy, acyl, cyano, nitro and trifluoromethyl groups; and X is of the structure:

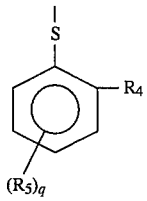

wherein $R_4$ and $R_5$ are individually selected from the group consisting of hydrogen, halogen, alkyl, alkoxy, aryloxy, carbonamido, ureido, carbamate, sulfonamido, carbamoyl, sulfamoyl, acyloxy, alkoxycarbonyl, aryloxycarbonyl, amino and carboxyl groups, and wherein q is 0, 1 or 2 and $R_5$ may be in the meta or para position with respect to the sulfur atom.

16. A silver halide photographic negative according to claim 14 wherein the inert dye is an azo, methine, azamethine or metallized dye.

17. A photographic negative according to claim 14 wherein the inert dye is selected from dyes having structure I, II or III:

I

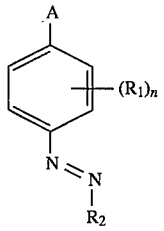

II

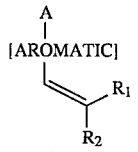

III

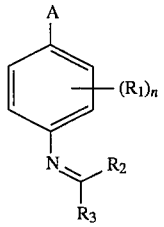

where A is a substituted or unsubstituted auxochrome which can optionally be part of a heterocyclic ring system; $R_1$, $R_2$, and $R_3$ are independently H or substituents provided that in each of I, II or III, $R_1$ and $R_2$ or $R_2$ and $R_3$ can form a ring.

18. A photographic negative according to claim 14 wherein the level of the coupler which forms the magenta dye is 0.01 to 5 g/m$^2$ and the inert dye level is 0.0002 to 5 g/m$^2$.

19. A photographic negative according to claim 14 wherein the level of the coupler which forms a magenta image dye is 0.02 to 2 g/m$^2$ and the inert dye level is 0.001 to 2 g/m$^2$.

20. A photographic negative according to claim 15 wherein the level of the coupler which forms a magenta image dye is 0.05 to 1 g/m$^2$ and the inert dye level is 0.01 to 1 g/m$^2$.

21. A silver halide photographic negative according to claim 15 wherein the negative, absent the inert dye, has a $D_{580}/D_{550}$ at neutral midscale exposure of 0.75 or less.

22. A silver halide photographic negative according to claim 15 wherein the negative, absent the inert dye, has a $D_{580}/D_{550}$ at neutral midscale exposure of 0.60 or less.

23. A silver halide photographic negative according to claim 15 wherein the inert dye increases $D_{580}/D_{550}$ of the negative at neutral midscale exposure by at least 0.01.

24. A silver halide photographic negative according to claim 15 wherein the inert dye increases $D_{580}/D_{550}$ of the negative at neutral midscale exposure by at least 0.05.

25. A silver halide photographic negative according to claim 15 wherein the inert dye is positioned in the layer containing the magenta coupler or another location in a direction toward the support.

* * * * *